US009716353B2

(12) United States Patent
Murata et al.

(10) Patent No.: US 9,716,353 B2
(45) Date of Patent: Jul. 25, 2017

(54) COAXIAL CONNECTOR

(71) Applicant: FUJITSU LIMITED, Kawasaki-shi, Kanagawa (JP)

(72) Inventors: Yoko Murata, Kawasaki (JP); Akira Tamura, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/068,680

(22) Filed: Mar. 14, 2016

(65) Prior Publication Data

US 2016/0294129 A1 Oct. 6, 2016

(30) Foreign Application Priority Data

Apr. 6, 2015 (JP) ..... 2015-077542

(51) Int. Cl.

| | |
|---|---|
| ***H01R 24/44*** | (2011.01) |
| ***H01R 13/24*** | (2006.01) |
| ***H01R 13/622*** | (2006.01) |
| ***H01R 13/631*** | (2006.01) |
| *H01R 24/50* | (2011.01) |

(52) U.S. Cl.

CPC ..... *H01R 24/44* (2013.01); *H01R 13/2428* (2013.01); *H01R 13/622* (2013.01); *H01R 13/6315* (2013.01); *H01R 24/50* (2013.01)

(58) Field of Classification Search

CPC ..... H01R 9/05; H01R 9/0515; H01R 12/714; H01R 24/38; H01R 24/44; H01R 24/50; H01R 13/2428

USPC ..... 439/63, 578, 581, 700, 75, 82, 289, 824

See application file for complete search history.

(56) References Cited

U.S. PATENT DOCUMENTS

| | | | | | |
|---|---|---|---|---|---|
| 3,366,920 | A * | 1/1968 | Laudig | H01R 24/44 | 439/581 |
| 3,879,103 | A * | 4/1975 | Peltola | H01R 9/0515 | 439/581 |
| 4,453,796 | A * | 6/1984 | Monroe | H01R 9/0518 | 439/581 |
| 5,366,380 | A * | 11/1994 | Reymond | H01L 24/72 | 257/E23.078 |
| 5,797,765 | A * | 8/1998 | Barnett | H01R 24/50 | 333/260 |
| 6,079,986 | A * | 6/2000 | Beshears | H01R 9/096 | 439/581 |

(Continued)

FOREIGN PATENT DOCUMENTS

| | | |
|---|---|---|
| JP | 63-000504 | 1/1988 |
| JP | 05-041259 | 2/1993 |

(Continued)

*Primary Examiner* — Tulsidas C Patel
*Assistant Examiner* — Travis Chambers
(74) *Attorney, Agent, or Firm* — Fujitsu Patent Center

(57) ABSTRACT

A disclosed coaxial connector includes: an external conductor having a cylindrical shape to be screwed together with a counterpart connector including a circular opening end, the external conductor having a contact surface provided on inner periphery of the external conductor, with which the opening end comes into contact, and also having a slit formed to allow the external conductor to stretch and shrink in a longitudinal direction of the external conductor; and a center conductor provided coaxial with the external conductor, the center conductor having a length long enough to reach a substrate on which the counterpart connector is provided upright.

6 Claims, 15 Drawing Sheets

(56) References Cited

U.S. PATENT DOCUMENTS

| | | | | |
|---|---|---|---|---|
| 6,086,383 | A * | 7/2000 | Fasano | H01R 12/57 439/63 |
| 6,699,054 | B1 * | 3/2004 | Critelli | H01R 13/6315 439/248 |
| 8,636,522 | B2 * | 1/2014 | Sykes | H01R 9/0515 439/63 |
| 8,747,153 | B2 * | 6/2014 | Takano | H01R 12/718 439/582 |
| 9,300,063 | B2 * | 3/2016 | Tatzel | H01R 12/714 |
| 9,318,824 | B2 * | 4/2016 | Hara | H01R 12/714 |
| 2013/0149897 | A1 | 6/2013 | Takano et al. | |
| 2013/0157505 | A1 * | 6/2013 | Sykes | H01R 9/05 439/578 |

FOREIGN PATENT DOCUMENTS

| | | |
|---|---|---|
| JP | 2009-052913 | 3/2009 |
| JP | 2013-084498 | 5/2013 |

* cited by examiner

COAXIAL CONNECTOR

CROSS-REFERENCE TO RELATED APPLICATION(s)

This application is based upon and claims the benefit of priority of the prior Japanese Patent Application No. 2015-077542, filed on Apr. 6, 2015, the entire contents of which are incorporated herein by reference.

FIELD

The embodiments discussed herein are related to a coaxial connector.

BACKGROUND

At a base station of cell phones and the like, a coaxial connector is used to transmit a high-frequency signal. A plug provided at the end of a coaxial cable and a receptacle which mates with the plug are both example of the coaxial connector.

The plug and the receptacle each include a center conductor and an external conductor surrounding the center conductor. When the plug and the receptacle mate with each other, the center conductors are connected to each other and the external conductors are connected to each other.

Note that techniques related to the present application are also described in the following documents: Japanese Laid-open Utility Model Publication No. 63-504, Japanese Laid-open Patent Publication No. 2013-84498, Japanese Laid-open Patent Publication No. 05-41259 and Japanese Laid-open Patent Publication No. 2009-52913.

SUMMARY

According to one aspect discussed herein, there is provided a coaxial connector including: an external conductor having a cylindrical shape to be screwed together with a counterpart connector including a circular opening end, the external conductor having a contact surface provided on inner periphery of the external conductor, with which the opening end comes into contact, and also having a slit formed to allow the external conductor to stretch in a longitudinal direction of the external conductor; and a center conductor provided coaxial with the external conductor, the center conductor having a length long enough to reach a substrate on which the counterpart connector is provided upright.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Prior to description of embodiments, matters investigated by the inventors of the present application are described.

As described above, coaxial connectors include a plug and a receptacle. Hereinafter, description is given of snap-in coaxial connectors which are easy to insert and pull out.

Figure 1:
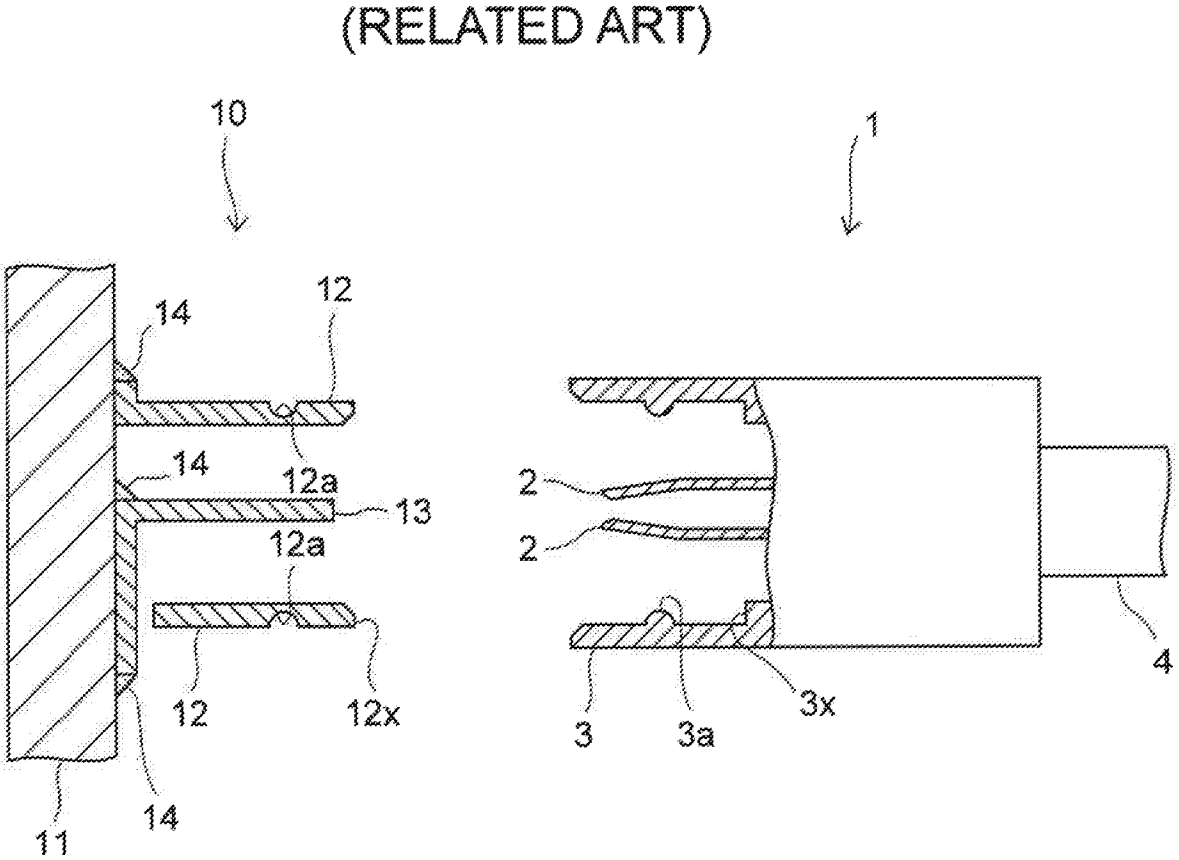
FIG. 1 is a partial cross-sectional side view of a pair of snap-in coaxial connectors used for consideration.

FIG. 1 is a partial cross-sectional side view of a pair of snap-in coaxial connectors used for the investigation.

One of these coaxial connectors is a plug 1 provided at the end of a coaxial cable 4, and the other of the coaxial connectors is a receptacle 10 provided upright on the surface of a circuit board 11.

The plug 1 includes a center conductor 2, which serve as a transmission line of a high-frequency signal. The plug 1 also includes an external conductor 3 for grounding, which surrounds the center conductor 2.

The external conductor 3 has an approximately cylindrical shape, and a mating protrusion 3*a* and a bottom 3*x* are provided on the inner periphery thereof.

On the other hand, the receptacle 10 includes a cylindrical external conductor 12 for grounding, which is fixed to the circuit board 11. Provided in the external conductor 12 is a pin-shaped center conductor 13, through which the high-frequency signal flows. In this example, the external conductor 12 and the center conductor 13 are both fixed to the circuit board 11 by solder 14.

Also, on the outer periphery of the external conductor 12, a mating recess 12*a* is provided, which mates with the mating protrusion 3*a* of the plug 1 described above. An opening end 12*x* of the external conductor 12 has a circular shape which is housed in the external conductor 3 of the plug 1.

Figure 2:
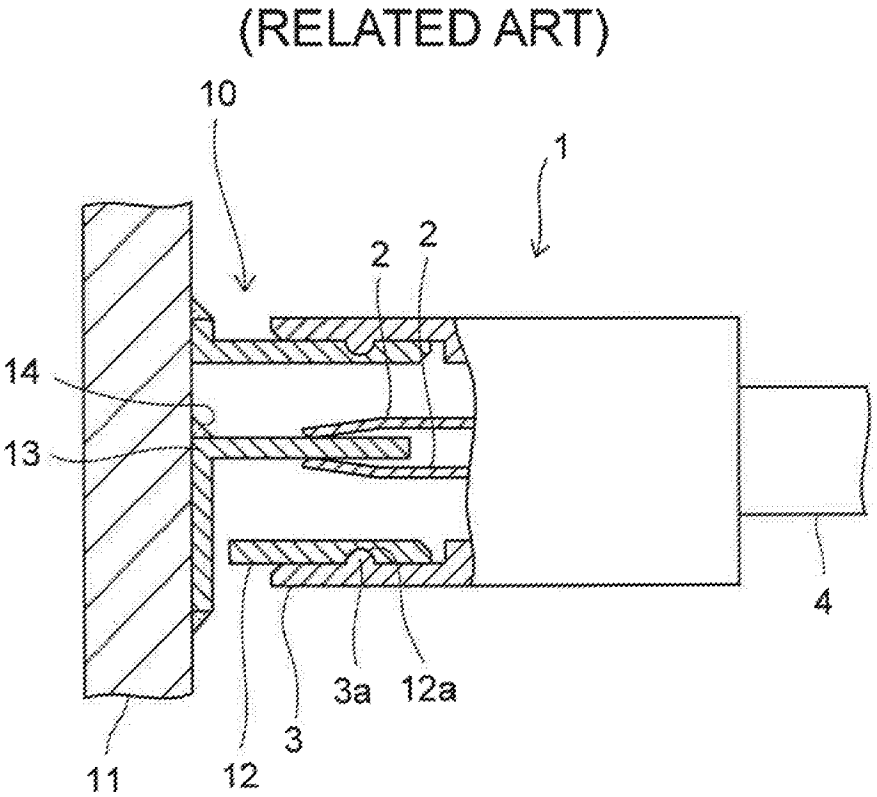
FIG. 2 is a partial cross-sectional side view illustrating a state where a plug is connected to a receptacle.

FIG. 2 is a partial cross-sectional side view illustrating a state where the plug 1 is connected to the receptacle 10.

In this state, the external conductors 3 and mate with each other, and thus the external conductors 3 and 12 are electrically connected to each other. Also, the pin-shaped center conductor 13 is held by the center conductor 2, and thus the center conductor 2 and 13 are electrically connected to each other.

Note that the plug 1 and the receptacle 10 are fixed to each other by fitting the mating protrusion 3*a* into the mating recess 12*a*. Therefore, the plug 1 can be easily pulled out of the receptacle 10.

The inventors of the present application measured characteristic impedance along a transmission line of a high-frequency signal in the state where the plug 1 and the receptacle 10 are connected to each other in this manner.

Figure 3:
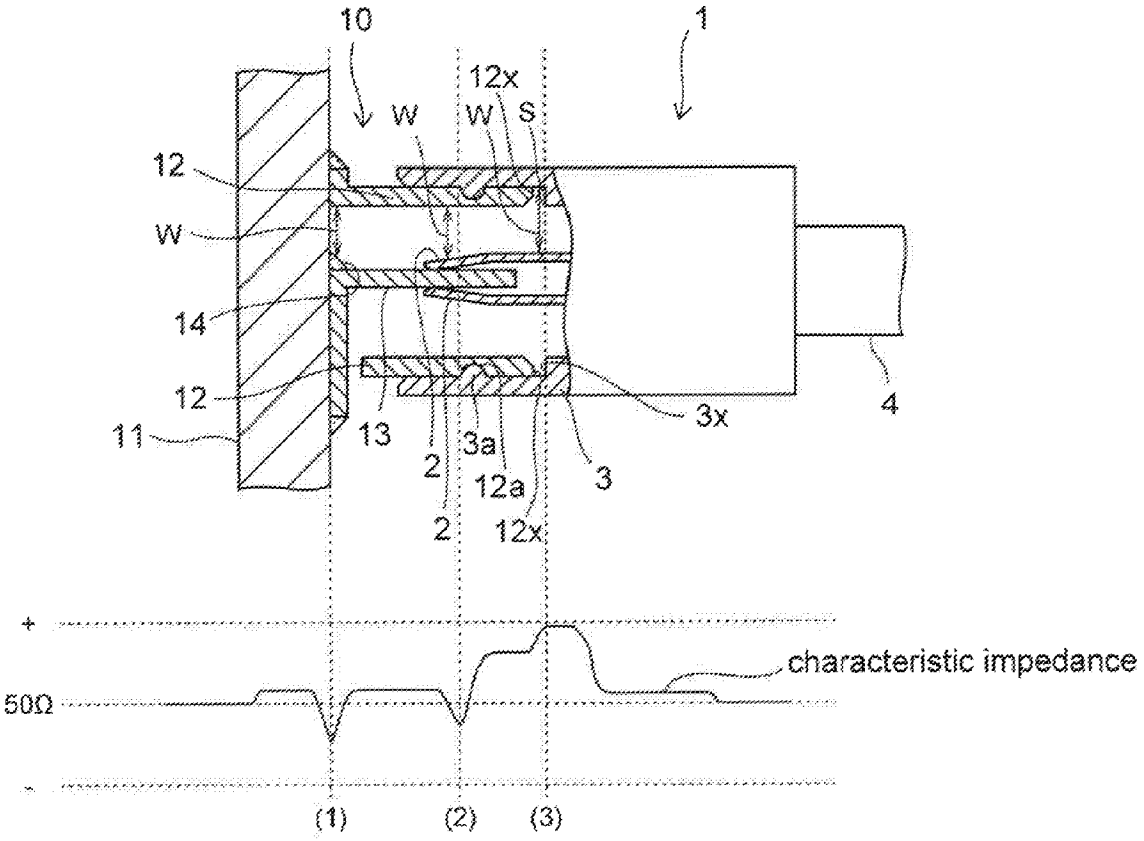
FIG.3 (RELATED ART)
FIG. 3 is a view illustrating a measurement result of characteristic impedance along a transmission line of a high-frequency signal in the state where the plug is connected to the receptacle.

FIG. 3 illustrates the measurement result.

In FIG. 3, the horizontal axis represents a position on the transmission line of the high-frequency signal, and the vertical axis represents characteristic impedance at this position.

In FIG. 3, the plug 1 and the receptacle 10 described above are also illustrated.

In many cases, the specification value of the characteristic impedance is 50Ω. However, in this example, there are some positions (1) to (3) where the characteristic impedance value significantly deviates from 50Ω as illustrated in FIG. 3.

This is considered to be because the characteristic impedance depends on a conductor interval W defined by the interval between a signal line and a grounded line, and therefore the characteristic impedance fluctuates at the positions (1) to (3) where the conductor interval W changes.

For example, the position (1) is on the surface of the circuit board 11. When the solder 14 spreads on the surface, the conductor interval W between the solder 14 and the external conductor 12 is reduced, leading to fluctuation in characteristic impedance at the position (1).

The position (2) is where the center conductor 2 and 13 are in contact with each other. When the center conductor 13 is held by the center conductor 2 as in this example, the conductor interval W is reduced by the thickness of the center conductor 2. Thus, the characteristic impedance also fluctuates.

The position (3) is where there is a space S between the opening end 12*x* of the external conductor 12 and the external conductor 13. When the space S is exposed to the center conductor 2, the conductor interval W increases. Thus, characteristic impedance fluctuates at the position (3).

Note that, in order to suppress the fluctuation in characteristic impedance at the position (3), it is also conceivable to eliminate the space S by bringing the opening end 12*x* into contact with the bottom 3*x* of the external conductor 13.

However, when the opening end 12*x* is brought into contact with the bottom 13*x*, there is no room for the receptacle 10 to be deeply pushed into the plug 1. Thus, when the position of the mating protrusion 3*a* is shifted due to variation in processing, the mating protrusion 3*a* may no longer be fitted into the mating recess 12*a*.

As described above, when there are the positions (1) to (3) where the characteristic impedance fluctuates, the high-frequency signal is reflected at these positions. As a result, return loss of the coaxial connector is increased.

Hereinafter, description is given of embodiments capable of suppressing reflection of the high-frequency signal.

First Embodiment

Figure 4:
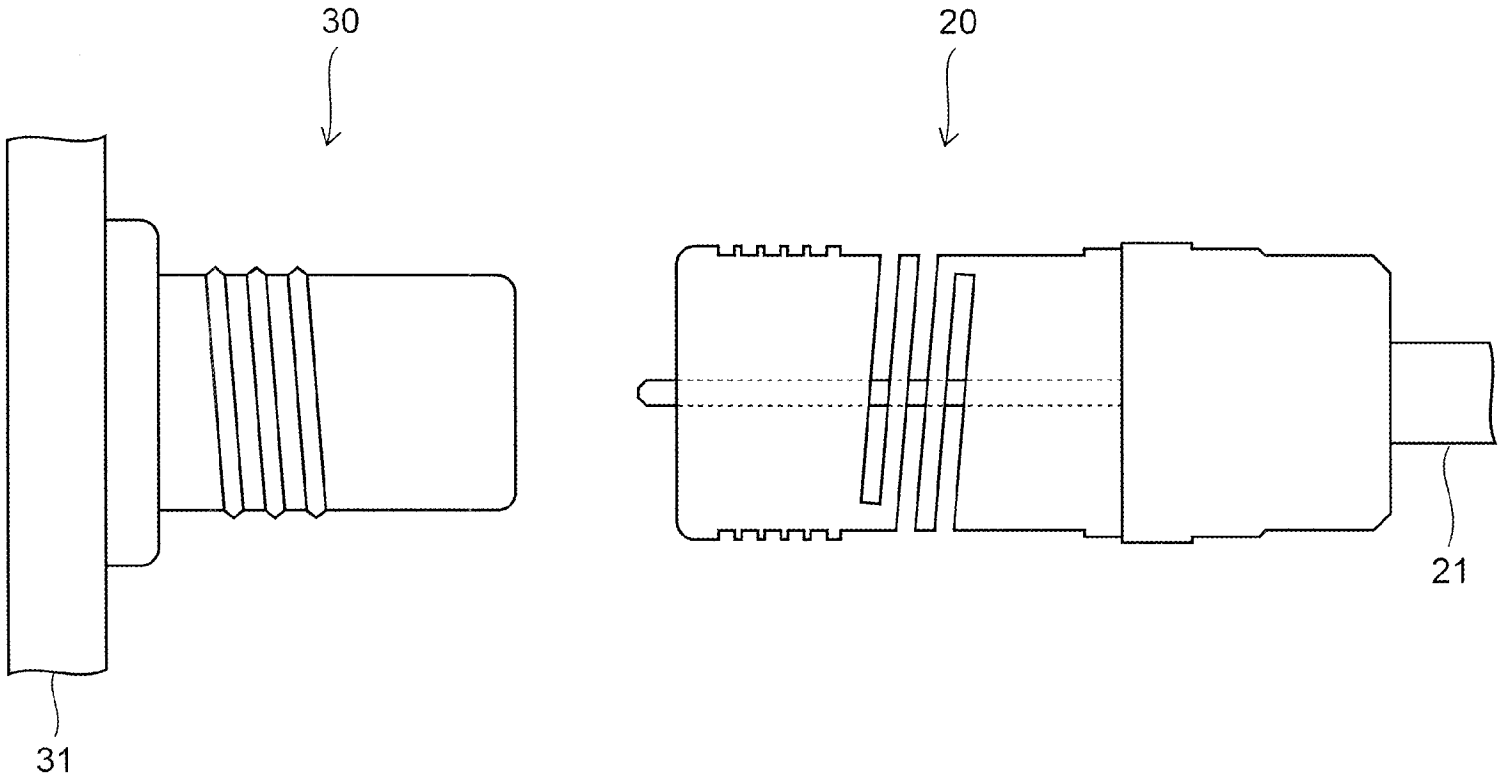
FIG. 4 is a side view of a pair of coaxial connectors according to a first embodiment.

FIG. 4 is a side view of a pair of coaxial connectors according to this embodiment.

One of these coaxial connectors is a plug 20 provided at the end of a coaxial cable 21, and the other thereof is a receptacle 30 provided upright on the surface of a circuit board 31.

Figure 5:
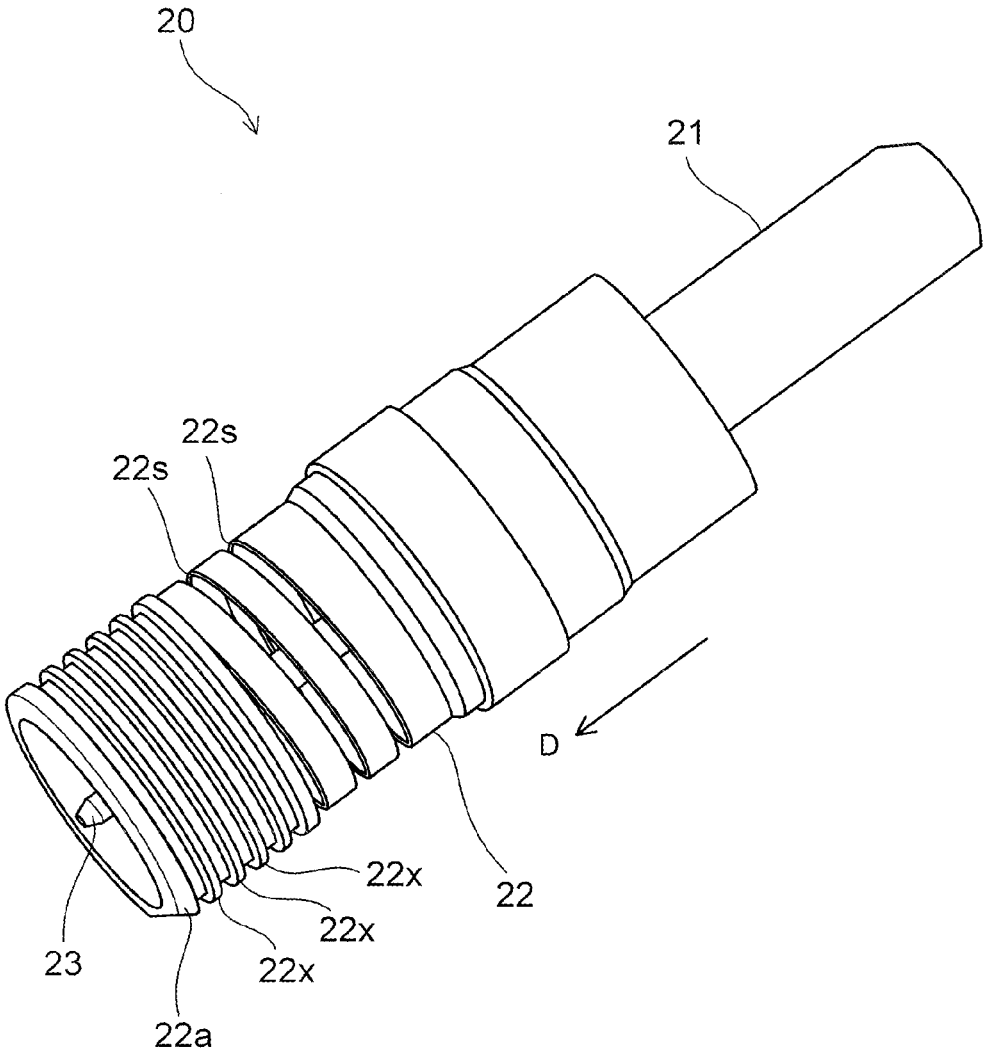
FIG. 5 is a perspective view of a plug according to the first embodiment.

FIG. 5 is a perspective view of the plug 20.

The plug 20 includes a cylindrical external conductor 22 and a pin-shaped center conductor 23 coaxial with the external conductor 22.

The external conductor 22 is provided with a spiral slit 22*s* having a width of about 0.5 mm to 1.0 mm. This slit 22*s* allows the external conductor 22 to freely stretch and shrink along a longitudinal direction D thereof, giving spring property to the external conductor 22.

Furthermore, on an outer periphery of the external conductor 22, a plurality of protrusions 22*x* are provided for a user to easily hold the plug 20.

Note that the dimensions of the plug 20 are not particularly limited. In this example, the diameter of the external conductor 22 is set to about 4.0 mm to 8.0 mm, and the thickness of the tube wall of the external conductor 22 is set to about 0.3 mm to 0.6 mm. Also, the length of the external conductor 22 along the longitudinal direction D is about 3.0 mm to 11.0 mm, for example.

Moreover, the diameter of the center conductor 23 is about 0.5 mm to 1.0 mm, for example.

Figure 6:
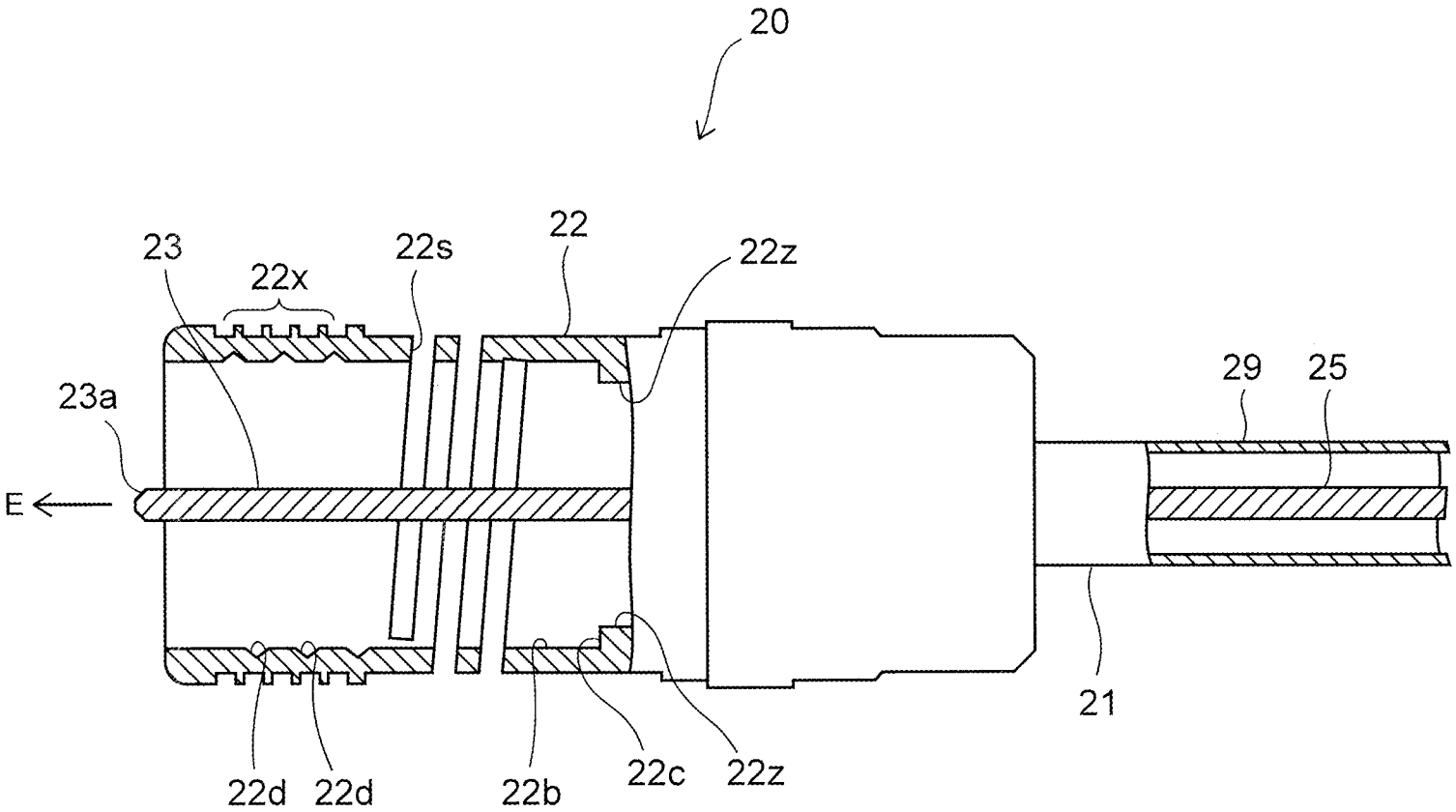
FIG. 6 is a partial cross-sectional side view of the plug according to the first embodiment.

FIG. 6 is a partial cross-sectional side view of the plug 20.

As illustrated in FIG. 6, the coaxial cable 21 includes a core 25, which is a transmission line of a high-frequency signal. The coaxial cable 21 also includes an external conductor 29 which surrounds the core 25.

The external conductor 29 is maintained at a ground potential and is electrically connected to the external conductor 22 of the plug 20 described above. Also, a cylindrical inner periphery 22*b* of the external conductor 22 is provided with a contact surface 22*c*, with which the receptacle 30 comes into contact as described later, and grooves 22*d* screwed together with the receptacle 30.

The shape of the contact surface 22*c* is not particularly limited. In this example, the contact surface 22*c* is provided perpendicular to the inner periphery 22*b* in a cross-sectional view.

Also, a cylindrical surface 22*z* connected to the contact surface 22*c* is provided on the inner periphery 22*b* closer to the base of the external conductor 22. The cylindrical surface 22*z* has a cylindrical shape having a diameter smaller than that of the inner periphery 22*b*, and is coaxial with the inner periphery 22*b*.

On the other hand, the center conductor 23 has a pin shape having a diameter approximately constant along an extension direction E thereof. Also, the center conductor 23 has a length such that a tip 23*a* thereof slightly protrudes from the external conductor 22 in a side view.

In this example, the core 25 of the coaxial cable 21 is extended to become the center conductor 23. However, a method for connecting the center conductor 23 to the core 25 is not limited thereto.

Figure 7A:
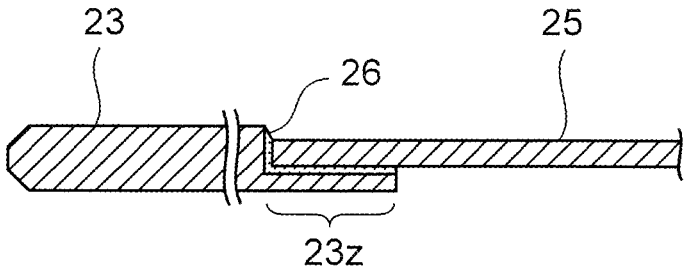
FIGS. 7A and 7B are enlarged cross-sectional views illustrating other examples of a method for connecting a conductor to a core in the first embodiment.
Figure 7B:
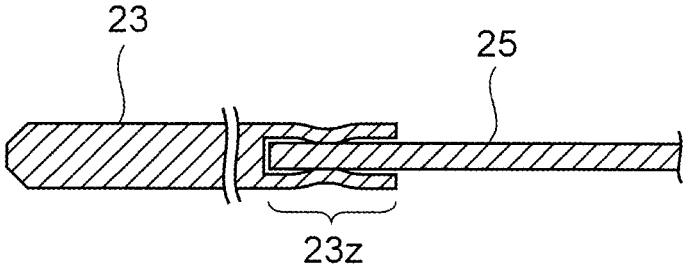

FIGS. 7A and 7B are enlarged cross-sectional views illustrating other examples of the method for connecting the center conductor 23 to the core 25.

In the example of FIG. 7A, a base 23*z* of the center conductor 23 is connected to the tip of the core 25 by a solder 26.

In the example of FIG. 7B, on the other hand, the base 23*z* of the center conductor 23 is made hollow, the core 25 is inserted into the base 23*z*, and then the center conductor 23 is pressure-bonded to the core 25 by swaging the base 23*z*.

The materials of the external conductor 22 and the center conductor 23 are not particularly limited, and metal such as brass can be employed as the material thereof. Moreover, in order to lower electric resistance of the center conductor 23, the center conductor 23 may be covered with a copper film.

Figure 8:
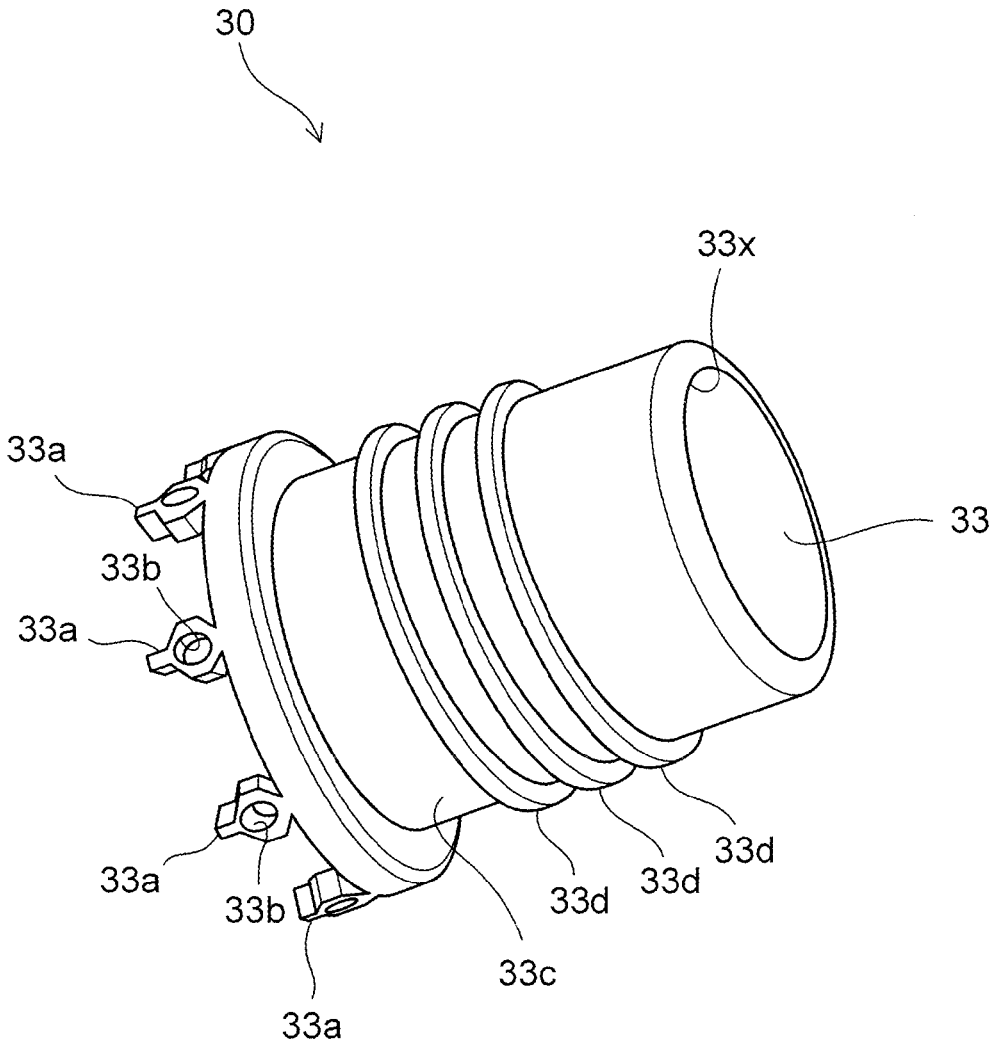
FIG. 8 is a perspective view of a receptacle according to the first embodiment.

FIG. 8 is a perspective view of the receptacle 30 that serves as a counterpart connector of the plug 20.

As illustrated in FIG. 8, the receptacle 30 includes an approximately cylindrical external conductor 33.

The material of the external conductor 33 is metal such as brass, and an opening end 33*x* thereof is approximately circular.

Also, at the base of the external conductor 33, a plurality of press-fit terminals 33*a* are provided. Each of the press-fit terminals 33*a* is provided with a hole 33*b*, which is collapsed by external force. With the hole 33*b* trying to expand against the external force, each press-fit terminal 33*a* exhibits elastic force.

Furthermore, an outer periphery 33*c* of the external conductor 33 is provided with threads 33*d* screwed together with the grooves 22*d* (see FIG. 6) in the plug 20.

Note that the dimensions of the external conductor 33 are not particularly limited. In this example, the diameter of the external conductor 33 is set to about 3.5 mm to 8.0 mm, and the thickness of the tube wall of the external conductor 33 is set to about 0.5 mm to 1.0 mm. Also, the length of the external conductor 33 along the longitudinal direction is about 5.0 mm to 10.0 mm, for example.

Figure 9:
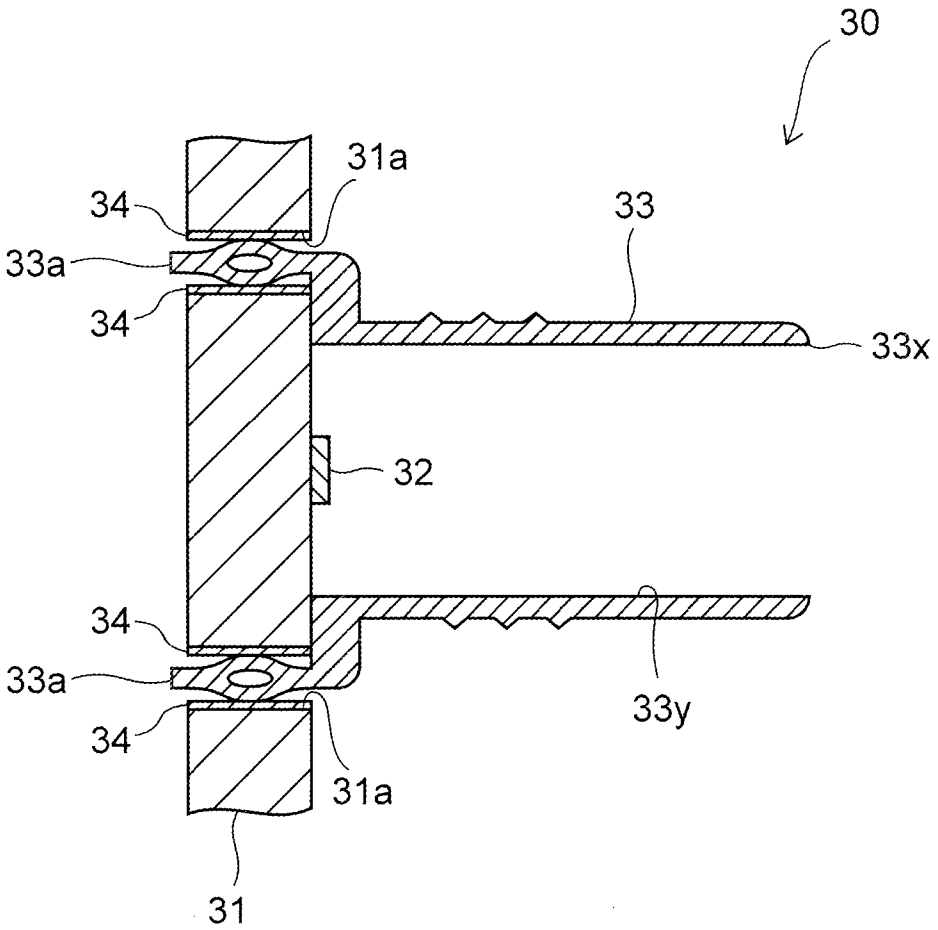
FIG. 9 is a cross-sectional view of the receptacle according to the first embodiment.

FIG. 9 is a cross-sectional view of the receptacle 30.

The receptacle 30 includes, besides the aforementioned external conductor 33, a center conductor film 32 formed on the surface of the circuit board 31. The external conductor 33 is provided upright on the circuit board 31, and the center conductor film 32 is included inside the external conductor 33.

The center conductor film 32 forms a part of a transmission line of a high-frequency signal, and is formed by patterning a copper foil having a thickness of about 30 μm to 100 μm, for example. Note that the center conductor film 23 is pulled out to the outside of the external conductor 33 through an unillustrated wiring.

Moreover, through-holes 31*a* each having a diameter of about 0.8 mm to 1.5 mm are formed in the circuit board 31. On an inner surface of each of the through-holes 31*a*, a grounding conductor film 34 such as a copper plated film is provided in a thickness of about 25 μm to 75 μm.

By press fitting the press-fit terminals 33*a* into the through-holes 31*a*, the external conductor 33 is fixed to the circuit board 31 by the elastic force of the press-fit terminals 33*a*, and the external conductor 33 and the grounding conductor film 34 are electrically connected to each other. Since the grounding conductor film 34 is maintained at a ground potential, the external conductor 33 is also grounded.

Note that the shape of an inner periphery 33*y* of the external conductor 33 is not particularly limited. In this example, the inner periphery 33*y* has a cylindrical shape without unevenness.

Figure 10:
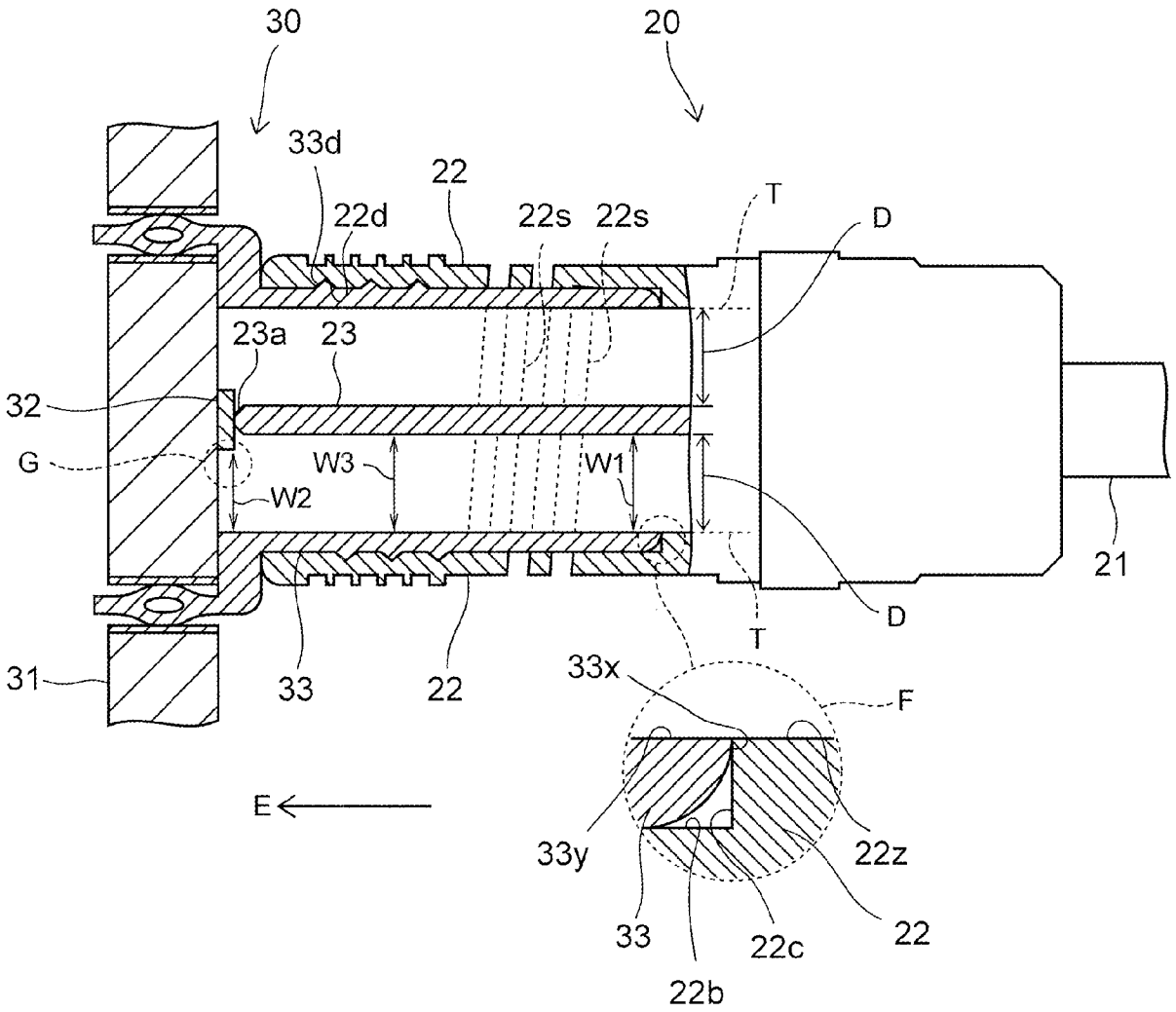
FIG. 10 is a partial cross-sectional side view illustrating a state where the plug is connected to the receptacle in the first embodiment.

FIG. 10 is a partial cross-sectional side view illustrating a state where the plug 20 is connected to the receptacle 30.

In order to connect the plug 20 to the receptacle 30, the user rotates the plug 20 in a state where the grooves 22*d* and the threads 33*d* are fitted together.

Thus, the plug 20 moves toward the receptacle 30 and, eventually, the tip 23*a* of the center conductor 23 comes into contact with the center conductor film 32. Accordingly, the center conductor 23 and the center conductor film 32 are electrically connected to each other. At the same time, the opening end 33*x* comes into contact with the contact surface 22*c*. Thus, the plug 20 and the receptacle 30 are completely connected to each other.

Here, since the external conductor 22 of the plug 20 has the spring property because of the slit 22*s* as described above, the external conductor 33 of the receptacle 30 has slight room for extension even after the center conductor 23 and the center conductor film 32 come into contact with each other or after the opening end 33*x* comes into contact with the contact surface 22*c*.

Therefore, the external conductor 33 of the receptacle 30 is extended by further pushing the plug 20 into the receptacle 30, and the spring property of the external conductor 22 of the plug 20 can allow the center conductor 23 to tightly contact to the center conductor film 32 or the opening end 33*x* to tightly contact to the contact surface 22*c*. Accordingly, the plug 20 can be surely connected to the receptacle 30.

Note that, in this state, no step is formed between the inner periphery 33*y* and the cylindrical surface 22*z*, and the inner periphery 33*y* and the cylindrical surface 22*z* form a continuous cylindrical tube wall T. This is also the case for a second embodiment to be described later.

According to this embodiment described above, the opening end 33*x* comes into contact with the contact surface 22*c* as illustrated in FIG. 10. Therefore, in the vicinity F of the opening end 33*x*, the space S as illustrated in FIG. 3 is not exposed to the center conductor 23.

As described above, the characteristic impedance of the coaxial connector depends on the conductor interval defined by the interval between the signal line and the grounded line. Since the space S is not exposed in this manner, a conductor interval W1 in the vicinity F of the opening end 33*x* becomes constant along the extension direction E of the center conductor 23.

Particularly, in this embodiment, the opening end 33*x* is pressed against the contact surface 22*c* by the spring property of the external conductor 22. Therefore, there is less room for the space to be generated in the vicinity F.

Moreover, the center conductor film 32 and the external conductor 33 are fixed to the circuit board 31 without using solder. Therefore, a conductor interval W2 does not change in the vicinity G of the surface of the circuit board 31 due to the solder wettably spreading on the circuit board 31.

Furthermore, the center conductor 23 and the center conductor film 32 are electrically connected to each other by making the center conductor 23 come into contact with the center conductor film 32. Since one of the center conductors is not held by the other as illustrated in FIG. 3, a conductor interval W3 also becomes approximately constant along the extension direction E.

As described above, the conductor intervals W1 to W3 are constant along the extension direction E. Therefore, the characteristic impedance is prevented from fluctuating along the extension direction E due to changes in the conductor intervals W1 to W3. Accordingly, reflection of a high-frequency signal can be suppressed in the plug 20 and the receptacle 30.

Particularly, as in this example, the center conductor 23 has the pin shape having a diameter approximately constant along the extension direction E thereof. Thus, changes in the conductor intervals W1 to W3 along the extension direction E can be more effectively suppressed.

Note that, in order to set the conductor intervals W1 to W3 constant along the extension direction E in this manner, it is preferable that the continuous cylindrical tube wall T is formed by the inner periphery 33*y* and the cylindrical surface 22*z* as described above, and an interval D between the tube wall T and the center conductor 23 is set constant along the extension direction E.

The inventors of the present application simulated how much reflection of a high-frequency signal is suppressed in the present embodiment.

Figure 11:
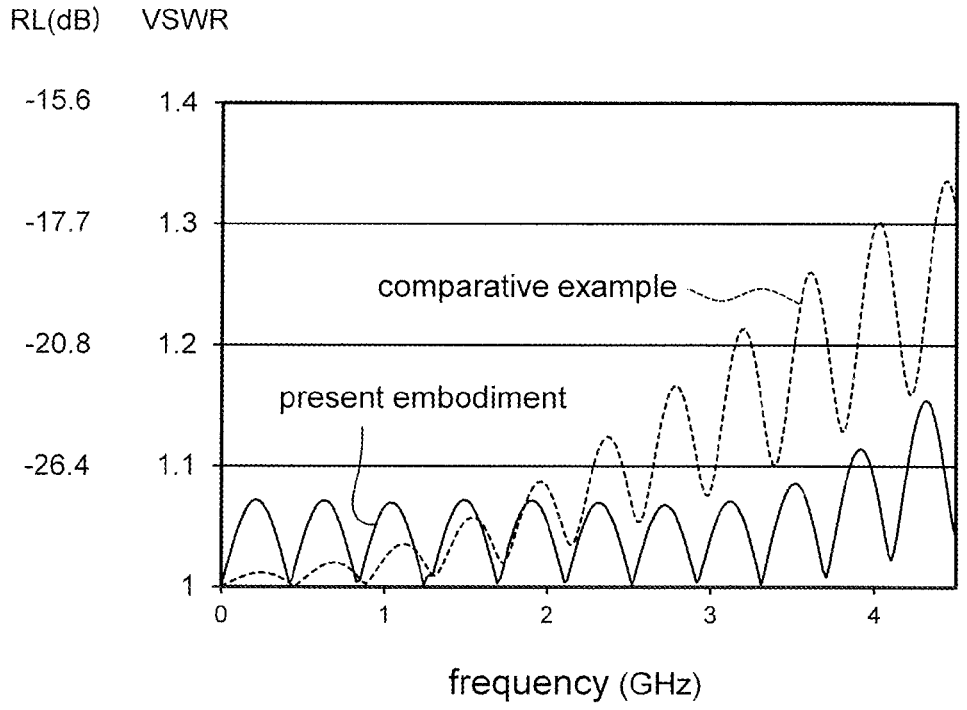
FIG. 11 is a graph obtained by simulation of how much reflection of a high-frequency signal is suppressed.

FIG. 11 illustrates the simulation result.

In FIG. 11, the vertical axis represents a voltage standing wave ratio (VSWR) of the high-frequency signal and a return loss (RL), and the horizontal axis represents a frequency of the high-frequency signal.

Note that a simulation result of the plug 1 and the receptacle 10 in FIG. 3 are also illustrated as a comparative example in FIG. 11.

As illustrated in FIG. 11, in the comparative example, the voltage standing wave ratio and the return loss are increased with an increase in frequency of the high-frequency signal. In practical use, it is preferable to set the VSWR to 1.1 or less. However, in the comparative example, the VSWR cannot be set to 1.1 or less unless the frequency is 2 GHz or less.

On the other hand, in the present embodiment, increases in voltage standing wave ratio and return loss are suppressed even when the frequency of the high-frequency signal is increased. The VSWR is suppressed to 1.1 or less even when the frequency is about 3.5 GHz.

This is considered to be because, in the present embodiment, the conductor intervals W1 to W3 are set constant along the extension direction E, and the characteristic impedance is prevented from fluctuating along the extension direction E, as described above.

From this result, it is actually confirmed that the reflection of the high-frequency signal is suppressed in the plug 20 and the receptacle 30 according to the present embodiment.

Second Embodiment

In the first embodiment, as described with reference to FIG. 10, the slit 22*s* gives the spring property to the external conductor 22, and this spring property presses the center conductor 23 against the center conductor film 32, thereby ensuring electrical connection between the center conductor 23 and the center conductor film 32.

In the present embodiment, the same is realized as follows without providing the slit 22*s* in the external conductor 22.

Figure 12:
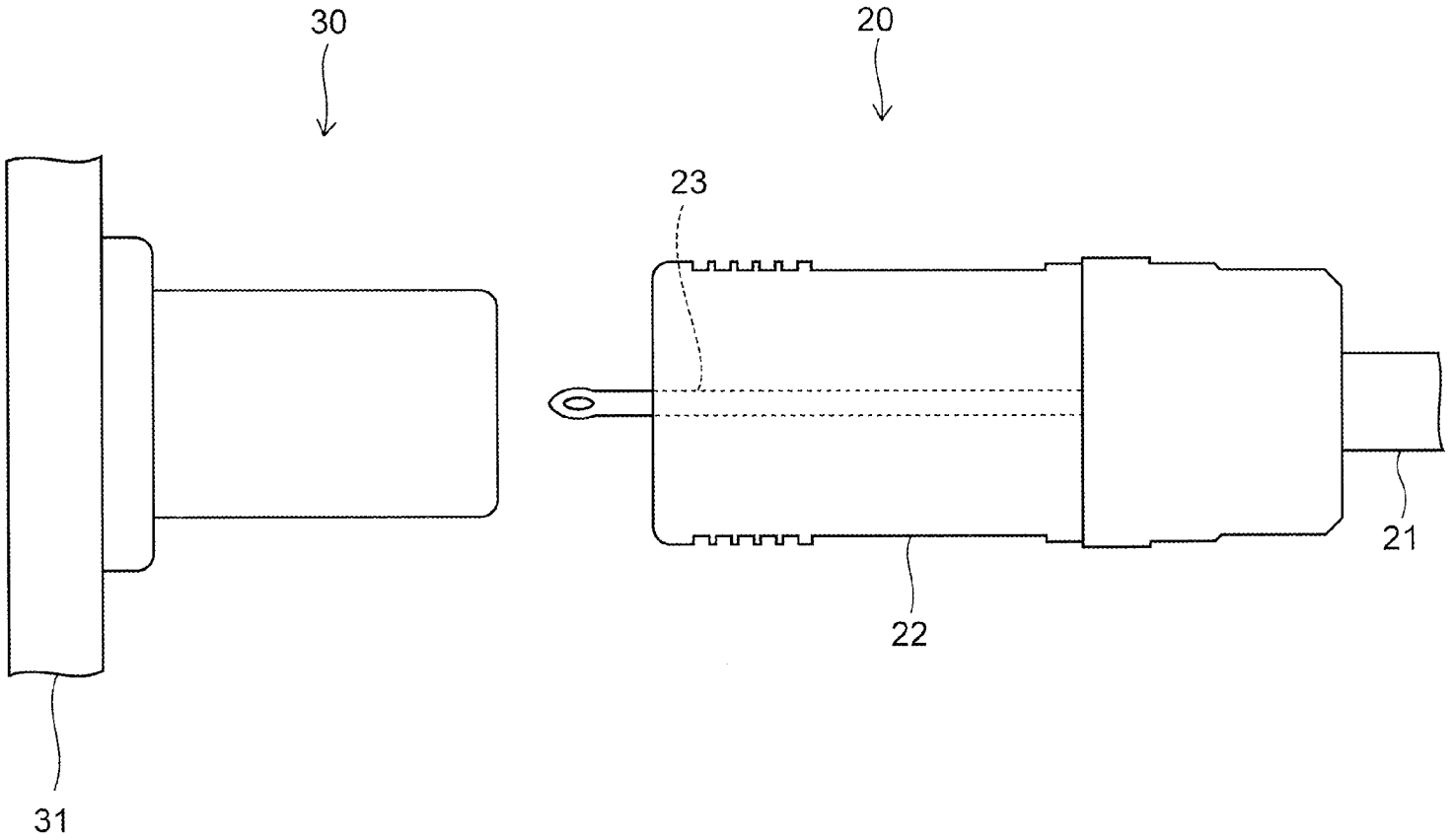
FIG. 12 is a side view of a pair of coaxial connectors according to a second embodiment.

FIG. 12 is a side view of a pair of coaxial connectors according to the present embodiment.

Note that, in FIG. 12, the same elements as those described in the first embodiment are denoted by the same reference numerals as those in the first embodiment, and description thereof is omitted below. This is also the case for FIGS. 13 to 15 to be described later.

As illustrated in FIG. 12, no slit is provided in an external conductor 22 of a plug 20 according to the present embodiment.

Figure 13:
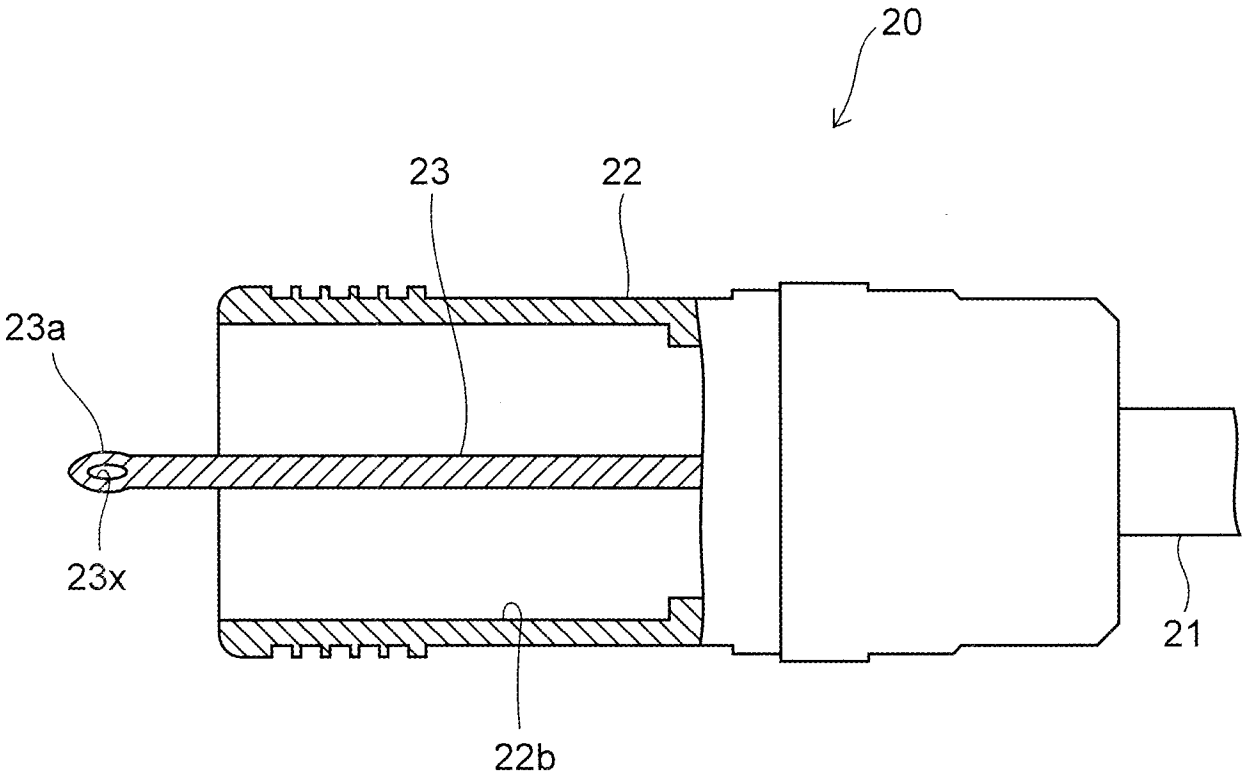
FIG. 13 is a partial cross-sectional side view of a plug according to the second embodiment.

FIG. 13 is a partial cross-sectional side view of the plug 20.

In the present embodiment, unlike the first embodiment, no threads are provided on an inner periphery 22*b* of the external conductor 22, and the inner periphery 22*b* has a cylindrical surface shape without unevenness.

A tip 23*a* of a center conductor 23 is a press-fit terminal provided with a hole 23*x*, which is collapsed by external force. With the hole 23*x* trying to expand against the external force, the tip 23*a* exhibits elastic force.

Figure 14:
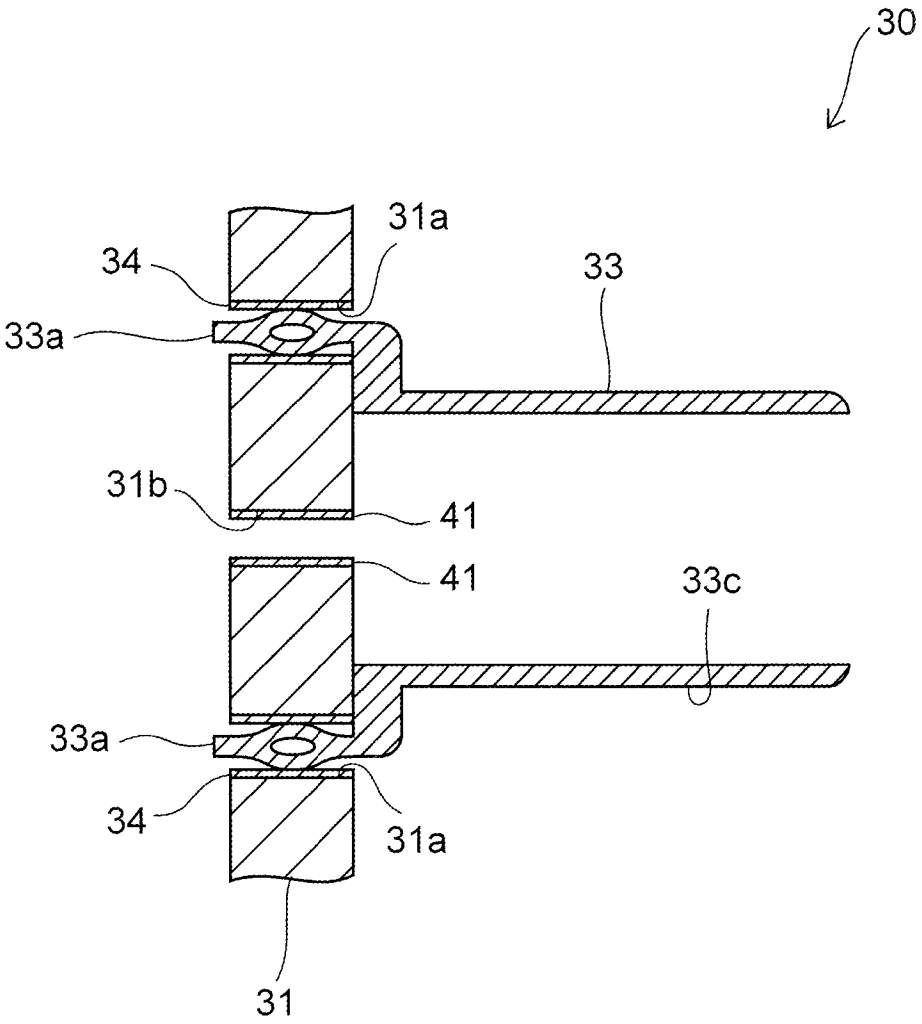
FIG. 14 is a cross-sectional view of a receptacle according to the second embodiment.

On the other hand, FIG. 14 is a cross-sectional view of a receptacle 30.

As illustrated in FIG. 14, a center through-hole 31*b* is provided in the circuit board 31 on the inside of the external conductor 33. The center through-hole 31*b* has a diameter which allows the tip 23*a* of the center conductor 23 to be freely inserted into the center through-hole 31*b*. In this example, the diameter of the center through-hole 31*b* is about 0.5 mm to 1.0 mm.

On the inner surface of the center through-hole 31*b*, a center conductor film 41 is provided, which serves as a part of a transmission line of a high-frequency signal. A method for forming the center conductor film 41 is not particularly limited. For example, the center conductor film 41 can be formed in a thickness of about 25 μm to 75 μm by copper plating or the like.

Note that, since the inner periphery 22*b* of the external conductor 22 of the plug 20 (see FIG. 13) has the cylindrical surface shape without unevenness, the outer periphery 33*c* of the external conductor 33 of the receptacle 30 also has a cylindrical surface without unevenness.

Figure 15:
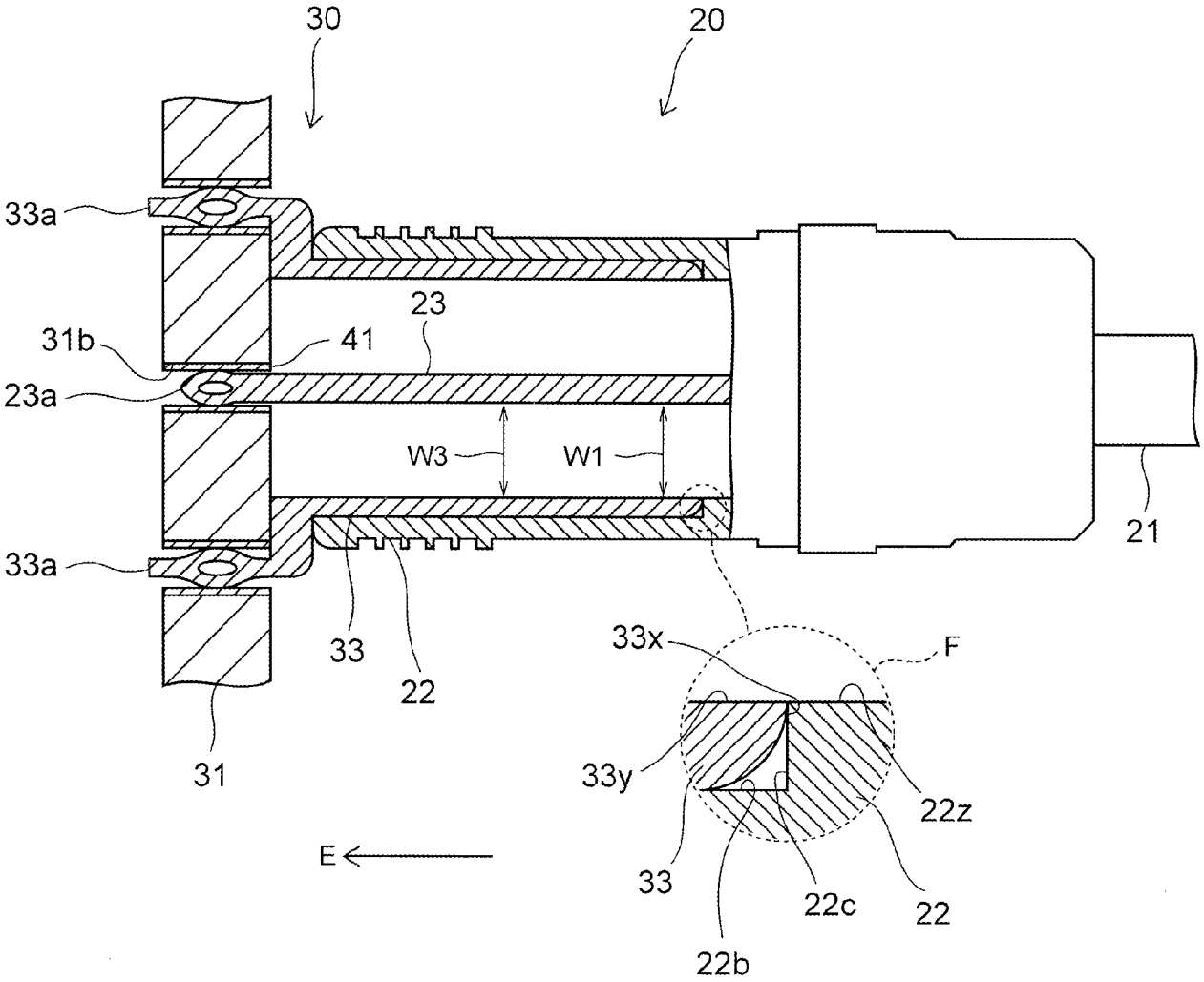
FIG. 15 is a partial cross-sectional side view illustrating a state where the plug is connected to the receptacle in the second embodiment.

FIG. 15 is a partial cross-sectional side view illustrating a state where the plug 20 is connected to the receptacle 30.

In order to connect the plug 20 to the receptacle 30, the user pushes the external conductor 22 of the plug 20 into the external conductor 33 of the receptacle 30, thereby making the opening end 33*x* come into contact with the contact surface 22*c* and press fitting the tip 23*a* of the center conductor 23 into the center through-hole 31*b*.

Thus, the external conductor 22 of the plug 20 and the external conductor 33 of the receptacle 30 are electrically connected to each other and, at the same time, the center conductor film 41 and the center conductor 23 are electrically connected to each other.

According to the present embodiment described above, the center conductor 23 and the center conductor film 41 are electrically connected to each other by inserting the center conductor 23 into the center through-hole 31*b*. Therefore, the present embodiment does not adopt the structure in which one of the center conductors is held by the other as illustrated in FIG. 3.

Thus, the conductor interval W3 can be set constant along the extension direction E of the center conductor 23.

Moreover, since the center conductor 23 is freely insertable into the center through-hole 31*b*, a pushing operation in pushing the external conductor 22 of the plug 20 into the external conductor 33 of the receptacle 30 is not hindered by the center conductor 23. As a result, contact between the contact surface 22*c* and the opening end 33*x* can be ensured. Thus, no space is generated between the contact surface 22*c* and the opening end 33*x* as in the case of the first embodiment. Accordingly, the conductor interval W1 is set constant also in the vicinity F of the opening end 33*x*.

As a result, the characteristic impedance can be prevented from fluctuating along the extension direction E due to changes in the intervals W1 and W3. Accordingly, reflection of a high-frequency signal due to the fluctuation in characteristic impedance can be suppressed.

Furthermore, since the center conductor 23 is freely insertable into the center through-hole 31*b* as described above, the center conductor 23 scrapes against the center conductor film 41, causing foreign substances such as dust to be eliminated from therebetween. As a result, the center conductor 23 and the center conductor film 41 are less likely to be electrically insulated from each other by the foreign substances. Thus, electrical connection between the center conductor 23 and the center conductor film 41 can be ensured.

Although the embodiments are described in detail above, the embodiments are not limited thereto.

For example, the intended use of the plug 20 and the receptacle 30 according to the embodiments are not particularly limited. The plug 20 and the receptacle 30 can be used for a small electronic device such as a notebook computer, a base station of a cell phone, an RRH (Remote Radio Head) and the like.

All examples and conditional language recited herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A coaxial connector comprising:

an external conductor having a cylindrical shape to be screwed together with a counterpart connector including a circular opening end, the external conductor having a contact surface provided on inner periphery of the external conductor, with which the opening end comes into contact, and also having a slit formed to allow the external conductor to stretch and shrink in a longitudinal direction of the external conductor; and a center conductor provided coaxial with the external conductor, the center conductor having a length long enough to reach a substrate on which the counterpart connector is provided upright.

2. A coaxial connector comprising:

an external conductor having a cylindrical shape to be fitted to a counterpart connector including a circular opening end, the external conductor having a contact surface provided on an inner periphery of the external conductor, the opening end coming into contact with the contact surface; and a center conductor provided coaxial with the external conductor and freely insertable into a center hole formed in a substrate on which the counterpart connector is provided upright, the counterpart connector being provided upright on the substrate, the center conductor is a press-fit terminal.

3. The coaxial connector according to claim 2, wherein the center conductor has a pin shape.

4. The coaxial connector according to claim 2, wherein a cylindrical surface connected to the contact surface is provided on the inner periphery, and an inner periphery of the counterpart connector and the cylindrical surface form a continuous cylindrical tube wall.

5. The coaxial connector according to claim 4, wherein an interval between the tube wall and the center conductor is constant along an extension direction of the center conductor.

6. A coaxial connector comprising:

a center conductor film formed on a surface of a substrate, where a center conductor of a counterpart connector coming into contact with the center conductor film; and an external conductor having a cylindrical shape to be fitted to the counterpart connector, the external conductor being provided upright on the substrate, and the center conductor film being included inside the external conductor, an outer periphery of the external conductor is provided with a thread to be screwed together with a groove in the counterpart connector.

* * * * *